US007094319B2

(12) United States Patent
Vihervaara et al.

(10) Patent No.: US 7,094,319 B2
(45) Date of Patent: Aug. 22, 2006

(54) ADDITIVE FOR PAPER MAKING

(75) Inventors: Tapio Vihervaara, Turku (FI); Kari Luukkonen, Raisio (FI); Veikko Niinivaara, Raisio (FI)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 376 days.

(21) Appl. No.: 10/767,740

(22) Filed: Jan. 30, 2004

(65) Prior Publication Data

US 2004/0188048 A1 Sep. 30, 2004

Related U.S. Application Data

(60) Division of application No. 10/134,497, filed on Apr. 30, 2002, now Pat. No. 6,716,313, which is a continuation-in-part of application No. 09/743,355, filed as application No. PCT/FI99/00601 on Jul. 7, 1999, now Pat. No. 6,398,912.

(30) Foreign Application Priority Data

Jul. 10, 1998 (FI) ..... 981586
Feb. 5, 1999 (FI) ..... 990227

(51) Int. Cl.
*D21H 17/29* (2006.01)

(52) U.S. Cl. ..... 162/175; 162/149; 162/185

(58) Field of Classification Search ..... 162/158, 162/163, 164.5, 164.6, 168.1, 175–177, 183–185, 162/141, 149; 510/450, 454; 524/47, 56, 524/58; 525/54.24, 54.31; 536/45; 210/705, 210/723, 725, 731, 734, 735; 106/206.1, 106/208.1, 208.4, 214.1
See application file for complete search history.

(56) References Cited

U.S. PATENT DOCUMENTS

| | | | |
|---|---|---|---|
| 3,770,472 | A | 11/1973 | Jarowenko |
| 3,875,054 | A | 4/1975 | Hunt et al. |
| 4,122,253 | A | 10/1978 | Watts et al. |
| 4,146,515 | A | 3/1979 | Buikema et al. |
| 4,373,099 | A | 2/1983 | Hubbard et al. |
| 5,858,174 | A | 1/1999 | Persson et al. |
| 6,210,475 | B1 | 4/2001 | Dauplaise et al. |
| 6,235,835 | B1 | 5/2001 | Niessner et al. |
| 6,375,798 | B1 | 4/2002 | Kightlinger et al. |

FOREIGN PATENT DOCUMENTS

| | | |
|---|---|---|
| EP | 0257338 A2 | 3/1988 |
| WO | WO 93/10305 | 5/1993 |
| WO | WO 97/35068 | 9/1997 |
| WO | WO 97/46591 | 12/1997 |
| WO | WO 98/24972 | 6/1998 |

OTHER PUBLICATIONS

Smook, G.A., Handbook for Pulp and Paper Technologies, Chapters 1 and 2, pp. 1-19(1992).

*Primary Examiner*—Eric Hug
(74) *Attorney, Agent, or Firm*—Shiela A. Loggins

(57) ABSTRACT

The object of the invention is an additive for paper making by means of which the dusting tendency of paper can be reduced. The agent is based on starch, the molecular size of which has been reduced, and which has been cationized to a charge of less than 1.5 meq/g with a quaternary nitrogen compound. The agent is added to the fiber pulp for paper making prior to web formation.

16 Claims, 2 Drawing Sheets

ADDITIVE FOR PAPER MAKING

CROSS-REFERENCE TO RELATED APPLICATIONS

Figure 1:
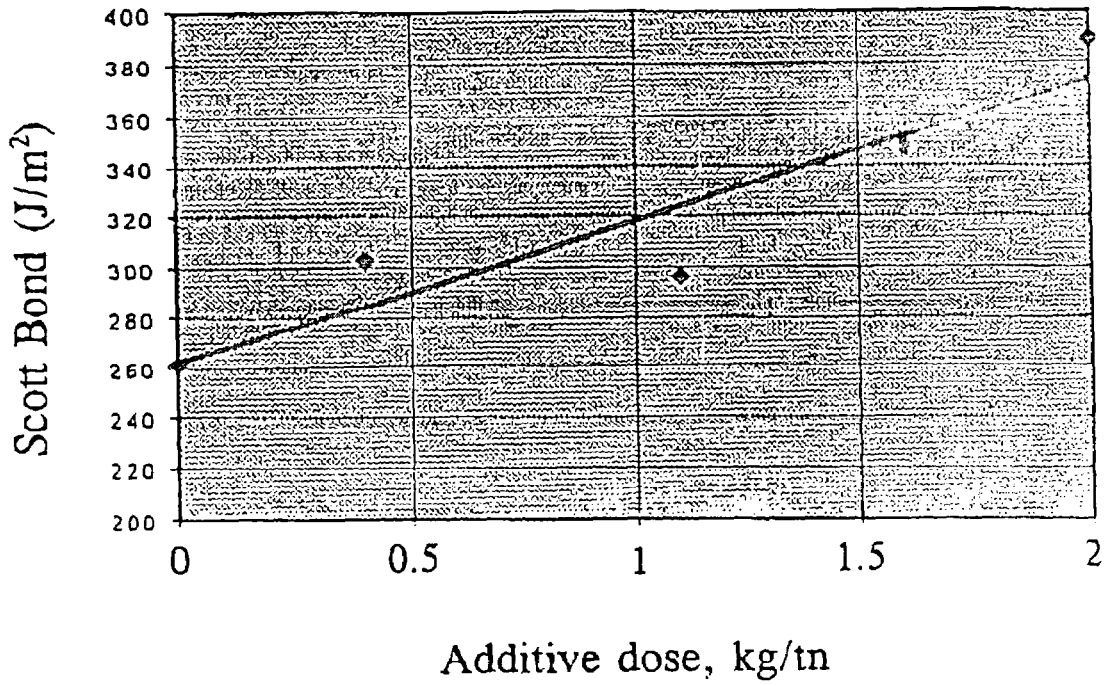

This a divisional of our U.S. application Ser. No. 10/134,497, filed Apr. 30, 2002, now U.S. Pat. No. 6,716,313, issued Apr. 6, 2004, which is a continuation-in-part of U.S. application Ser. No. 09/743,355, filed Jan. 9, 2001, now U.S. Pat. No. 6,398,912, issued Jun. 4, 2002, which is a National Stage application of PCT/FI99/00601, filed Jul. 7, 1999.

TECHNICAL FIELD

The present invention concerns an additive for paper making, which is added to the fiber pulp prior to the web formation step in a paper making process. By means of the additive it is possible to impart to the paper i.a. a reduced tendency for dusting. In addition, the additive has been shown to facilitate water removal in the web formation stage, to improve filler retention, and to affect advantageously the removal of harmful substances, which have accumulated in the water circulation system of the paper machine. The additive also increases the strength of the finished paper, both dry strength and wet strength. By using the additive for paper making according to the invention improvements have been seen also in the printability of the paper, i.a. as regards its applicability for ink-jet printing. The term paper as used in this application also includes the term paperboard.

BACKGROUND OF INVENTION

A problem that is encountered in finished paper is its high tendency for dust formation, the reason for which are fiber particles and filler particles released from the paper surface. The dust gives rise to problems already at the drying stage in paper making, but above all in the machines and equipments handling paper, such as in printing equipment. The printing methods as such are developed which means high machine speeds and long printing series. High speeds aggravate dust formation, and long printing series reduce standing times, during which it would be possible to carry out a cleaning of the equipments.

In order to solve the dusting problem it is known to use methods, which is a rule are based on chemical compounds to be added to the fiber pulp, prior to the paper web formation. The use of mineral and micro waxes, of sizing agents, such as AKD and ASA dispersions, of wet strength resins and of pulp sizing starch is known. Irrespective of these known measures, paper dusting is still a significant problem.

Low strength between long fibres, short fibres and fines and fillers give rise to increased dust formation. The number of contact points between fibres, fines, fillers and dry strength aid e.g. wet end starch impact on strength properties. A large number of the contact points, into which starch or other dry strength aid is adsorbed in between, leads to good strength properties. In cases where the quantity of short fibres, fines and fillers is high and the amount of long fibres is thus correspondingly low, conventional non-degraded cationic starches do not increase strength in a satisfactory way. One possible explanation is that the molecular weight of starch is too big to reach in a sufficient quantity to the contact points or the quantity of the molecules is just too little and the result is thus poor strength.

Fiber lengths of fibrous material, which is used on paper making are typically between 0.05–4 mm. The fractionation of fibrous material can be done by several means e.g. by Bauer-McNett or by Clark classifier. The classification of fibres in pulp is described e.g. in Tappi Test Method T 233 cm-95. The term long fibres mean in this application those fibres with the fiber length 1.68 mm or greater. Fibres longer than 1.68 mm mean those fibres, which retain on Tyler screen 10 according to Tappi Test Method T 233 cm-95, in the case that the length of the fibres can't be determined otherwise. The term fibres means in this application long fibres, short fibres and fine material, which is based on fibrous material. Fillers are thus excluded in the term fibres.

SUMMARY OF INVENTION

Now it has surprisingly been discovered that i.a. the dusting of paper can be reduced significantly by means of the additive according to the invention to be added to the fiber pulp prior to web formation. The said additive functions well, when it is used in the pulp, in which the long fiber content is 60% or below calculated from the total fiber content, more preferably if the long fiber content is 50% or below and most preferably if the long fiber content is 45% or below.

The additive is based on starch, which has been modified to be applicable in the invention by reducing its molecular size and reacted with an appropriate nitrogen compound in order to provide a suitable cationic charge level to the starch.

BEST AND VARIOUS MODES FOR CARRYING OUT INVENTION

The reduction of the molecular size has been carried out advantageously by oxidizing, such as by peroxide oxidation. But also other oxidants such as hypochlorites and persulfates can be used as well as degradation method. Also other commonly known degradation methods e.g. degradation by acids can be used as a degradation method. The reduction of the molecular size is appropriately carried out so that the viscosity of a 5% starch suspension at 60° C. is in the range 10–500 mPas (Brookfield). The viscosity is advantageously 40–300 mPas, and especially advantageously in the range 100–200 mPas. Oxidation to viscosity level of 10–500 mPas can be achieved for example using a hydrogen peroxide dose of 0.02–2% from the starch dry matter in slightly alkaline reaction conditions. The desired degree of degradation is also bound to the desired cationic charge of the end product, since an increase in the cationic charge decreases the viscosity of the end product. There is also interdependence between the molecular size and the cationic charge which affects the behaviour of the starch in the paper machine i.e. the retention of highly degraded molecules is improved by increased cationic charge level of the molecules.

Starch which has been processed to have the desired viscosity level is thereafter processed with a quaternary nitrogen compound according to the present invention so that its cationic charge level will be in the range <1.5 meq/g (meq/g means in this application milliequivalent of charges per gramme of dry, nonaqueous polymer), preferably in the range 0.36–1.46 meq/g, advantageously 0.72–1.46 meq/g and especially advantageously in the range 0.72–1.10 meq/g, whereby the nitrogen contents when using the quaternary cationizing chemical, will be correspondingly in the range 0.50–2.04%, 1.01–2.04% and 1.01–1.54%. The product is advantageously prepared using solution cationization, in which the starch is fed into the cationization process in granular form, the process conditions are chosen so that the starch dissolves completely during the process. Essential process quantities in this respect are the concentration of the starch to be cationized, suitable alkalinity and increased temperature. The alkali dose (NaOH) is siutably in the range of approximately 1.5–3% of the starch dry matter, and the temperature suitably in the range of approximately 60–80° C. The dry matter content of the reaction mixture should advantageously be over 50%, which gives i.a. a good yield for the end product. A suitable quaternary cationizing chemical is 2,3-epoxypropyltrimethylammonium chloride, which should be used in an amount of approximately 10–40% of the amount of starch.

The spirit of the invention also comprises the use of other suitable cationization methods e.g. dry cationization method, in which the moisture content is typically below 30% and in which starch remains powder like. Also cationization can be alternatively done prior to the oxidation step.

The applicability of the invention is illustrated with the following examples, in which i.a. paper properties, which have an effect on the dusting of the paper in, different paper handling conditions, have been monitored. Measuring the dusting tendency from a paper is as such problematic without a prolonged run of the paper in an application process, such as a printing operation. It is, however, generally known that the tendency for dust formation correlates to strength parameters which can be measured from the paper, such as Dennison, IGT and Scott Bond.

EXAMPLE 1

In this example the test was carried out under full-scale practical printing conditions using a paper fabricated on a newspaper machine. On the newspaper machine which had a capacity of 700 tons/24 hours a paper was made from a pulp of pressure groundwood and thermomechanical pulp. Before web formation, a starch based chemical according to the invention was mixed to the pulp in the pulp mixer on the suction side of the pump in a dose of 1.5–2.5 kg/ton. Paper made in this way was then printed in a printing house, whereby it could be established that the time between cleaning of the printing rollers increased from 80000 copies to 350000 copies. The used additive had been manufactured so that to starch which had been oxidatively degraded to a usable viscosity level (100–200 mPas, 5%, 60° C., Brookfield), had been cationized with 2,3-epoxypropyltrimethylammonium chloride using this cationizing chemical in an amount of 25% of the starch dry matter. The nitrogen content of the starch was 1.5% (charge 1.07 meq/g). From the paper also the Scott Bond value which indicates the interlaminar strength (bonding strength) was measured as one characteristic. These values have been given as a function of the additive dose in the appended FIG. 1. When comparing to dust measurements carried out it could be established that the Scott Bond value of the paper clearly correlated to the dusting and printability properties.

EXAMPLE 2

A test series was carried out on a newspaper machine having a capacity of appr. 800 tons/24 hours. The composition of the pulp used for the paper mPas 50/50 TMP/DIP (thermomechanical/deinked). The test run lasted for 24 hours, during which time the change in strength values was monitored for different amounts of additives. The used additive had been manufactured so that the starch which had been oxidatively degraded to a viscosity level of approximately 200 mPas (5%, 60° C., Brookfield) was cationized with 2,3-epoxypropyltrimethylammonium chloride using this cationizing chemical in an amount of 15% of the amount of starch. The nitrogen content of the starch was 1.0% (charge 0.72 meq/g).

The results are given in the following table 1.

| | Additive dose, kg/t | Scott Bond $J/m^2$ | Dennison | IGT m/s | Burst $kPam^2/g$ |
|---|---|---|---|---|---|
| 1. | 0 | 198.6 | 7.0 | 1.36 | 1.38 |
| 2. | 0 | 190.6 | 7.0 | 1.30 | 1.45 |
| 3. | 1 | 195.4 | 8.0 | 1.77 | 1.47 |
| 4. | 1.4 | 205.9 | 7.0 | 1.95 | 1.42 |
| 5. | 1.8 | 194.0 | 9.0 | 1.33 | 1.51 |
| 6. | 1.4 | 297.6 | 9.0 | 1.26 | 1.44 |
| 7. | 3 | 238.3 | 9.5 | 1.53 | 1.47 |
| 8. | 3 | 304.3 | 10.0 | 1.56 | 1.41 |
| 9. | 3 | 299.9 | 9.5 | 1.57 | 1.52 |
| 10. | 3 | 213.5 | 9.0 | 1.22 | 1.50 |
| 11. | 3 | 227.4 | 9.0 | 1.50 | 1.48 |
| 12. | 3 | 225.6 | 9.0 | 1.59 | 1.48 |
| 13. | 3 | 207.6 | 9.0 | 1.60 | 1.56 |
| 14. | 3 | 241.1 | 9.0 | 1.49 | 1.52 |
| 15. | 3.5 | 280.1 | 9.0 | 1.57 | 1.49 |
| 16. | 4 | 260.6 | 9.0 | 1.36 | 1.53 |
| 17. | 0 | 246.9 | 8.0 | 1.26 | 1.42 |
| 18. | 0 | 212.8 | 8.0 | 1.18 | 1.41 |

From the results it can be seen that it is possible to affect the strength properties which in turn affect the dusting properties of the paper by means of the product according to the invention.

EXAMPL 3

Figure 2:
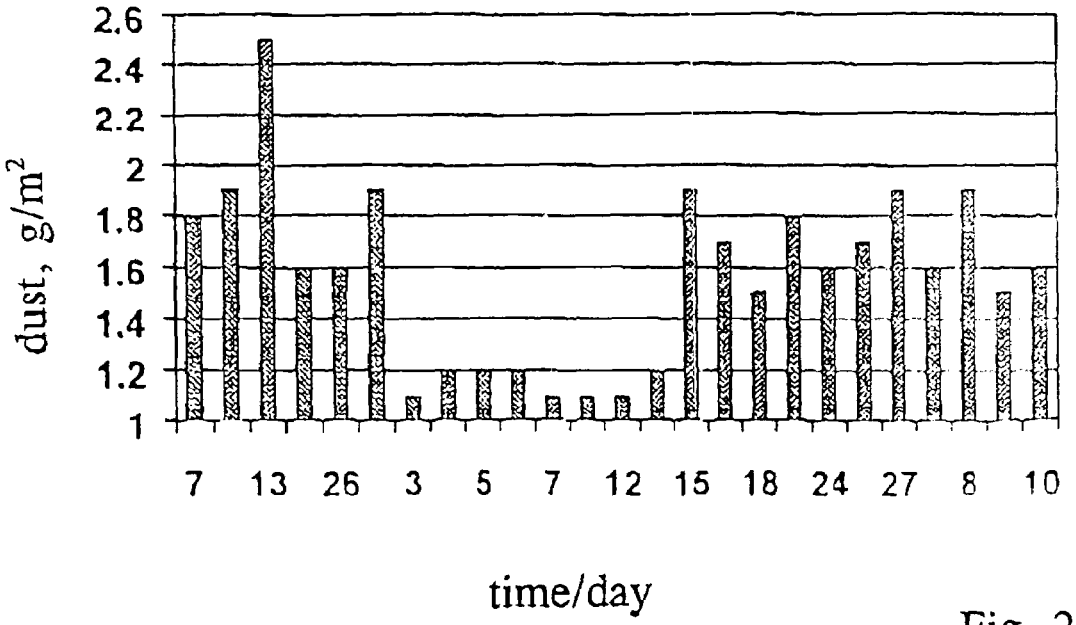

A test run lasting for 2 weeks was carried out on a newspaper machine which had a capacity of 400 tons/24 hours. For the paper raw material, peroxide bleached pressure groundwood was used. To the pulp conventional pulp starch was added in an amount of 10–13 kg/ton for the whole test run. A period of 12 days (the test days 3 to 14) was included in the test run, during which time an additive according to the invention was added to the pulp prior to web formation, in an amount of 2.5 kg/ton, in addition to the conventional pulp starch, the additive having been prepared in a manner similar to the additive of example 1. From the paper, printing series of 4000 sheets each from a paper sample taken each day was run in a test printer, from which printing series the dust amount was measured. The test results have been presented as a bar diagram in the appended FIG. 2. The results show a clear decrease in the amount of dust irrespective of the fact that a conventional internal size was present in the paper manufacture, which for its part should participate in reducing dusting.

EXAMPLE 4

A test run was carried out on a newspaper machine by running newsprint (30–40 $g/M^2$) the fiber base of which was pressure groundwood, thermomechanical pulp, chemical pulp and deinked pulp. The machine was operated at an acid pH-range. A bentonite/PAM microparticle retention system was used as the retention system. An additive according to the example 1 was fed to the mixing container on the suction side of the pump in an amount of 1,0 kg/ton.

Figure 3:
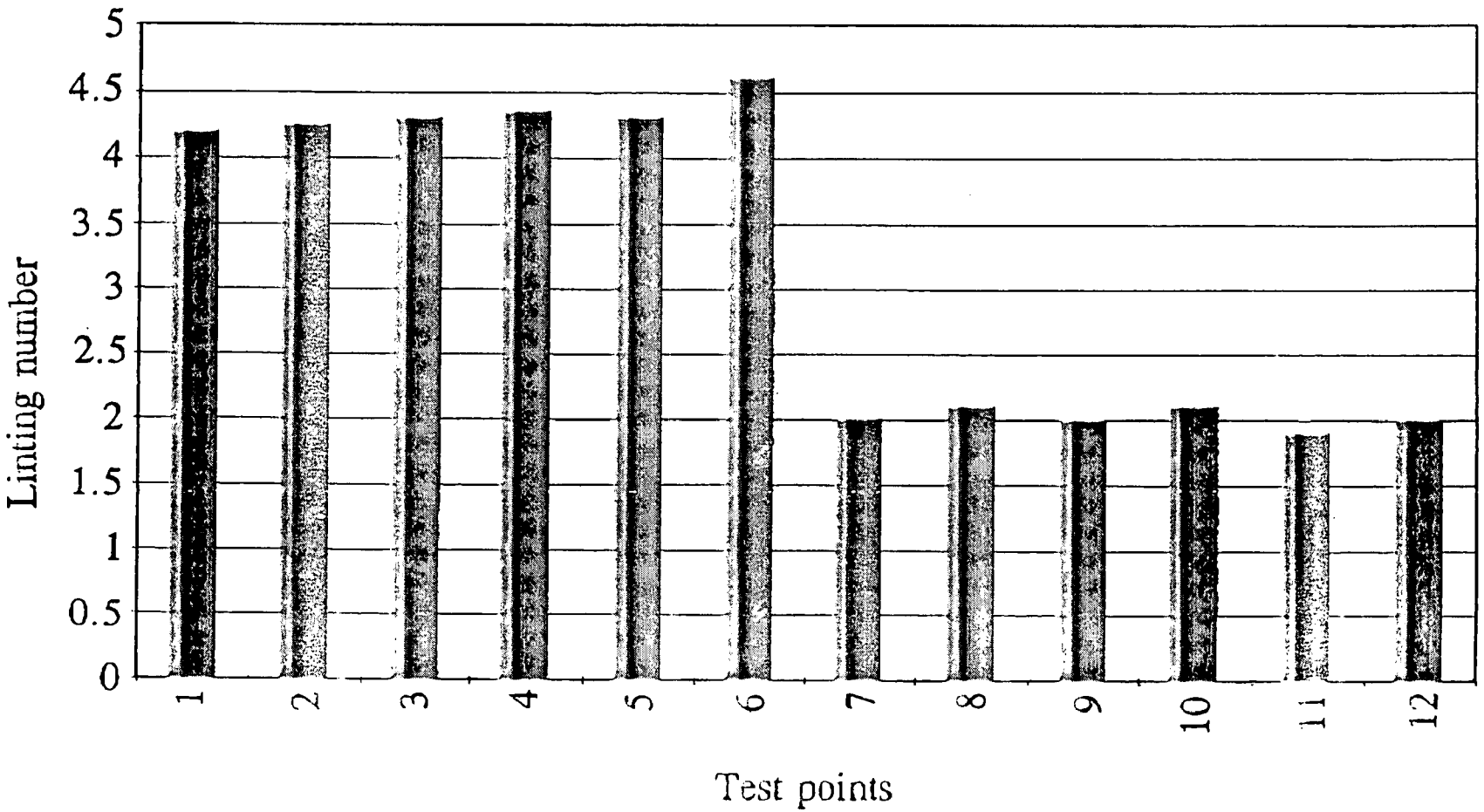

The behaviour of the finished paper was monitored online with a dust measuring device (MB Linting Dusting Tester). The results are given in the appended FIG. 3. It could be seen that the dusting had decreased 50–60% (test points 7–12) as compared to a corresponding paper without the additive according to the invention (test points 1–6).

Differences could be seen also in the operation of the paper machine as compared to manufacturing a corresponding paper without the additive according to the invention, i.a. water drainage improved, which manifested itself as a reduction in the steam requirement in the drying section. Also an advantageous affect as regards retention could be seen which resulted in a decrease of approximately 50% in the retention aid (PAM, polyacrylamide).

EXAMPL 5

A test series was carried out in a laboratory. Pulp used in the test was Indonesian tropical mix 70% and Scandinavian kraft pulp (long fiber pine) 30%. 21% of the fibres in the tropical mix and 90% of the fibres in the kraft pulp had fiber length over 1,68 mm (long fibres). So the content of long fibres was thus 42% of the total fiber content. Ground calcium carbonate was used as a filler and the content of it was 20%. The Schopper & Riegler value of the pulp was 25 and consistency 3% (thick stock). pH of the pulp was 7,2.

Tested additives:

Conventional cationic wet end starch (non-degraded cationic starch, nitrogen content: 0,3%, cationic charge level: 0,21 meq/g). Starch was cooked in 5% consistency in microwave oven (700 W, 8 min) prior to use. The cooked starch solution was diluted to 1% solution, which was used in the test series.

Additive according to the invention (cationic degraded starch, Nitrogen content: 1.5%, cationic charge level 1.07 meq/g, starch was in liquid form and as 20% water solution, viscosity 1900 mPas (23° C., Brookfield, 100 rpm, spindle 5). Additive was diluted 0,5% solution which was used in the test series.

Chemicals were dosed into the thick stock (consistency 3,0%) and mixture was agitated for 2 min. Stock was diluted with tap water to the consistency of 0.4% and mixture was agitated for 1 min. Sheet was then made with a dynamic sheet former (DSF/Fibertech). Sheets were pressed twice, first with 2 bar pressure and then with 4 bar pressure. Sheets were then dried with a laboratory drum dryer. Drying temperature was 110° C. and drying time 1 min. Grammages of the sheets was 70 g/m$^2$. Strength properties were measured from dried paper.

In the first test series (test series A) conventional cationic starch and the additive according to the invention were used independently. In the second test series (test series B) a part of the conventional wet end starch was replaced by the additive according to the invention. In the test series B the additive according to the invention was dosed first and the agitated for 1 min before the dosage of conventional wet end starch.

Results:

| Test series A: | | | | |
|---|---|---|---|---|
| | Starch | | | |
| | Cat. starch, non-degr, CCL: 0.21 meq/g | Cat. starch, degr. CCL: 1.07 meq/g | | |
| Dosage | 1% | 0.2% | 0.4% | 0.6% |
| Elongation, cross dir. (%) | 4.66 | 4.26 | 4.95 | 5.29 |

-continued

| Test series A: | | | | |
|---|---|---|---|---|
| | Starch | | | |
| | Cat. starch, non-degr, CCL: 0.21 meq/g | Cat. starch, degr. CCL: 1.07 meq/g | | |
| Burst Index (kPam$^2$/g) | 2.04 | 1.99 | 2.10 | 2.40 |
| Scott Bond (J/m$^2$) | 199 | 176 | 258 | 259 |
| Dennison | 8 | 12 | 12 | 13 |

The term CCL in the table means cationic charge level.

The test results clearly show the effect of the additive according to invention. Dosage of 0.4% gives much better values to all of the strength properties tested compared to the conventional wet end starch with dosage of 1%.

| Test series B: | | | | |
|---|---|---|---|---|
| Cat. starch, non-degr. CCL: 0.21 meqv/g | 1% | 0.8% | 0.6% | 0.4% |
| Cat. Starch, degr. CCL: 1.07 meqv/g | 0% | 0.1% | 0.2% | 0.3% |
| Elongation, cross dir (%) | 4.61 | 4.75 | 4.98 | 5.34 |
| Burst index (kPam2/g) | 2.19 | 2.20 | 2.19 | 2.31 |
| Scott Bond J/m2) | 237 | 250 | 262 | 294 |
| Folding Strength | 338 | 437 | 510 | 1150 |

The results show that when the additive according to invention is used together with the conventional wet end starch the strength properties are increased. Conventional wet end starch could also be dosed prior or simultaneously or mixed to the additive according to the invention, but the dosage order, in which additive according to the invention is dosed first is preferred.

The invention claimed is:

1. An additive for the production of paper or paperboard from pulp, said additive comprising starch which has been degraded to a viscosity level of 10–500 mPas (5%, 60° C., Brookfield) and cationized to a charge level of 0.36–1.46 meq/g.

2. The additive according to claim 1, wherein the starch has been degraded by peroxide oxidation.

3. The additive according to claim 1, wherein the starch has been degraded to a viscosity level of 40–300 mPaS (5%, 60° C., Brookfield).

4. The additive according to claim 1, wherein the starch has been degraded to a viscosity level of 100–200 mPaS (5%, 60° C., Brocklield).

5. The additive according to claim 1, wherein the starch has been cationized by solution cationization.

6. The additive according to claim 1, wherein the starch has been eationized by dry cationization.

7. The additive according to claim 1, wherein the starch has been cationized to a charge level of 0.36–1.10 mEq/g.

8. The additive according to claim 1, wherein the starch has been cationized to a charge level of 0.72–1.46 rnEq/g.

9. The additive according to claim 1, wherein the starch has been cationized to a charge level of 0.72–1.10 mEq/g.

10. The additive according to claim 1, wherein the starch has been degraded before being cationized.

11. The additive according to claim 1, wherein the starch has been cationized before being degraded.

12. A method of decreasing dusting of paper or paperboard, comprising adding an additive according to claim 1 to the pulp before web formation.

13. A method according to claim 12, comprising adding said additive in an amount of 1.0–3.0 kg/ton.

14. A method according to claim 12, wherein the additive is used together with conventional wet end starch.

15. A method according to claim 14, wherein the additive is dosed before the conventional wet end starch.

16. A pulp composition for producing paper or paperboard, which composition comprises a starch additive according to claim 1.

* * * * *